United States Patent [19]

Ross

[11] 4,001,778

[45] Jan. 4, 1977

[54] FLASHER LAMP/PROTECTIVE CONTAINER ASSEMBLY

[76] Inventor: Edward T. Ross, 110 Day St., Newington, Conn. 06111

[22] Filed: Oct. 9, 1973

[21] Appl. No.: 404,512

[52] U.S. Cl. ..... 340/114 B; 340/119; 340/81 R; 340/87; 240/102 R; 116/33; 40/125 N

[51] Int. Cl.[2] ..... E01F 9/01

[58] Field of Search ..... 340/114 B, 81 R, 119, 340/63, 280, 283; 240/54 R, 102 R, 102 B; 116/45, 49, 114 L, 33, 75, 77; 180/84; 40/125 N, 125 H

[56] References Cited

UNITED STATES PATENTS

| | | | |
|---|---|---|---|
| 1,068,033 | 7/1913 | Allard | 240/102 R |
| 2,014,872 | 9/1935 | Wells | 240/102 B |
| 2,918,668 | 12/1959 | Stube | 340/81 R |
| 3,092,826 | 6/1963 | Klingner | 340/114 B |
| 3,266,015 | 8/1966 | Pickering et al. | 340/81 R |
| 3,321,742 | 5/1967 | Nunn | 340/114 B |
| 3,500,378 | 3/1970 | Pickering et al. | 340/81 R |
| 3,652,845 | 3/1972 | Thomas | 240/54 R |
| 3,697,738 | 10/1972 | Decker et al. | 340/81 R |

*Primary Examiner*—John W. Caldwell
*Assistant Examiner*—Donnie Crosland

[57] ABSTRACT

An assembly is provided consisting of a flasher lamp of the type commonly found employed on barricades at construction sites as a means of providing a visual warning of the existence of a possible hazardous condition, and of a protective container for the flasher lamp operable for protecting the latter against theft and/or physical damage rising from vandalism, from the barricades being knocked over, etc. The protective container comprises an enclosure of mesh construction formed from a material having a multiplicity of holes provided therein. The enclosure is provided with an open end suitably dimensioned to permit the flasher lamp to be inserted therethrough into the interior of the enclosure. Fastener means are provided operable for attaching the protective container to the barricade to provide a theft-proof mounting thereof. In addition, the enclosure is provided with mounting means adapted to be employed in mounting the flasher lamp within the enclosure. The flasher lamp includes lamp means operable for providing a visual warning signal and housing means on which the lamp means is supported. The housing means has provided thereon means which cooperates with the mounting means of the enclosure for purposes of assembling the flasher lamp and the enclosure together whereby the flasher lamp is capable of being locked within the protective container so as to prevent the unauthorized removal thereof therefrom.

8 Claims, 4 Drawing Figures

FLASHER LAMP/PROTECTIVE CONTAINER ASSEMBLY

BACKGROUND OF THE INVENTION

It has long been known to provide warning devices at construction sites, road hazards, etc. in an effort to call the public's attention as they pass thereby to the fact that a possible hazardous condition exists at that particular location. The function of such warning devices obviously is to prevent people from being injured and/or property from being damaged as a result of their coming into contact with the source of danger. One of the various forms of warning devices which is often employed in this connection is barricades. The latter which are commonly made from either wood or metal are generally of relatively large size. Accordingly, such barriers normally are capable of being readily seen during daylight hours by an approaching pedestrian, an approaching cyclist as well as by someone who may be in an approaching vehicle.

During times of impeded visibility such as at night, during periods of inclement weather, etc., however, it may become difficult to see such barricades. As a result, such barricades themselves may at times present a form of hazard. It has therefore become a common practice to mount some type of light in each barricade. In this connection, it has been found that a flashing light is generally more effective in calling someone's attention to the barricade than is a lamp which emits a continuous beam of light.

The form of flasher which presently seems to be most commonly employed for this purpose is a lamp which embodies therewithin its own self-contained power supply, and which is in appearance characterized by the fact that the lamp portion thereof which is generally circular in configuration is of a distinctive yellowish orange color. More specifically, this form of flasher lamp is basically of two-part construction comprising a lamp portion consisting of a bulb and a cover therefor made from a suitable translucent material thereby to permit light rays to pass therethrough, and a housing which functions as a support for the lamp portion and which houses therewithin the components of a self-contained power supply such as a battery. In addition, the housing of the flasher lamp generally is provided with some form of attaching means operable for purposes of attaching the flasher lamp to an external support member such as a barricade. Inasmuch as the flasher lamp is primarily intended to be empoyed outdoors, suitable sealing means are embodied therein to provide the flasher lamp with a watertight construction and one which is capable of providing a relatively long operating life notwithstanding its exposure for extended periods to different types of weather conditions. The aforedescribed form of flasher lamp has proven in practice to be capable of providing dependable service with a minimum need under normal operating conditions for maintenance to be provided thereto.

However, such flasher lamps when they are placed in actual use for purposes of marking hazardous locations have proven susceptible to being stolen or to having serious damage done thereto as a result of acts of vandalism being performed thereon. As a result, it has become readily apparent that a need exists to provide the flasher lamp with some form of means capable of protecting the former from vandalism and from damage as a result of either the barricade being struck and knocked down or the manhandling which is customary in construction activity. In addition, it is also desirable to provide some means which is operable for purposes of preventing the theft of the flasher lamps which are quite valuable. At the same time, provision must still be made to enable access to be had to the flasher lamp for purposes of enabling the replacement of battery or bulb, or to permit repairs to be accomplished thereon.

Accordingly, it is an object of the present invention to provide a novel and improved assembly consisting of an illuminating means operable as a warning device and of a protective cover therefor.

It is also an object of the present invention to provide such an assembly of an illuminating means and a protective container therefor which also embodies mounting means operable for mounting the assembly to an external support member.

It is another object of the present invention to provide such an assembly of an illuminating means and a protective container therefor wherein the protective container is operable for purposes of protecting the illuminating means from damage done as a result of vandalism, or from being struck and knocked down, etc. A further object of the present invention is to provide such an assembly of an illuminating means and a protective container therefor, the latter being operable to protect the illuminating means against theft.

A still further object of the present invention is to provide such an assembly of an illuminating means and a protective container therefor wherein access is still capable of being had to the illuminating means to enable maintenance to be performed thereon and/or minor repairs to be made thereto.

Yet another object of the present invention is to provide such an assembly of an illuminating means and a protective container therefor which is easy to employ and is not readily susceptible to the effects of exposure to different types of weather conditions, yet is simple to assemble and relatively inexpensive to manufacture.

SUMMARY OF THE INVENTION

It has now been found that the foregoing and related objects can be readily attained in an assembly consisting of an illuminating means of the type commonly found employed as a warning device at hazardous locations to warn of danger thereat, and of a protective container for the illuminating means operable for protecting the latter against theft and/or physical damage arising from vandalism, from being struck and knocked over, etc. The protective container comprises a substantially closed enclosure having one end thereof open. The latter open end is suitably dimensioned to permit the illuminating means to be inserted therethrough into the interior of the enclosure. Fastener means are provided operable for attaching the protective container to an external support member to provide a theft-proof mounting thereof. In addition, the enclosure is provided with mounting means adapted to be employed in mounting the illuminating means within the enclosure. The illuminating means includes lamp means operable for providing a visual warning signal and housing means on which the lamp means is supported. The housing means has provided thereon means which cooperates with the mounting means of the enclosure for purposes of assembling the illuminating means and the enclosure together whereby the illuminating means is capable of being locked within the protective container so as to prevent the unauthorized removal thereof therefrom.

In accord with the preferred embodiment of the invention, an assembly has been provided wherein the illuminating means comprises a flasher lamp of the type commonly found employed mounted on a barricade to call attention thereto. The protective container comprises an enclosure of wire mesh construction having an open bottom. The mesh is of sufficient size to permit the fasteners, which comprise the fastener means by which the assembly is mounted on a barricade, to be passed therethrough. Preferably a pair of threaded fasteners are utilized for this purpose with the threaded ends of the fasteners first being inserted through suitable openings provided therefor in the barricade, then passed through openings which inherently exist in the side wall of the enclosure by virtue of the mesh construction thereof, and with a pair of nuts thereafter being positioned thereon. The latter nuts are tightened on the threaded ends of the fasteners so as to establish a secure connection between the assembly and the barricade. Moreover, the nuts are tack welded to the inner surface of the enclosure to provide a substantially theft-proof mounting, i.e., to prevent the unauthorized removal of the assembly from the barricade. The cooperating means embodied in the flasher lamp by means of which the flasher lamp is mounted within the enclosure comprises a through opening formed in the housing means of the flasher lamp. The latter opening is suitably dimensioned so as to be capable of receiving therein a special lock bolt which requires for its operation special tools. A washer-like member is welded to the inside surface of the enclosure. The special lock bolt is inserted through one of the openings existing in the mesh side wall of the enclosure, and through the hollow center of the washer-like member into the hollow interior of the flasher lamp housing thereby to lock the flasher lamp in place within the protective container.

DETAILED DESCRIPTION OF THE ILLUSTRATED EMBODIMENT

Figure 1:
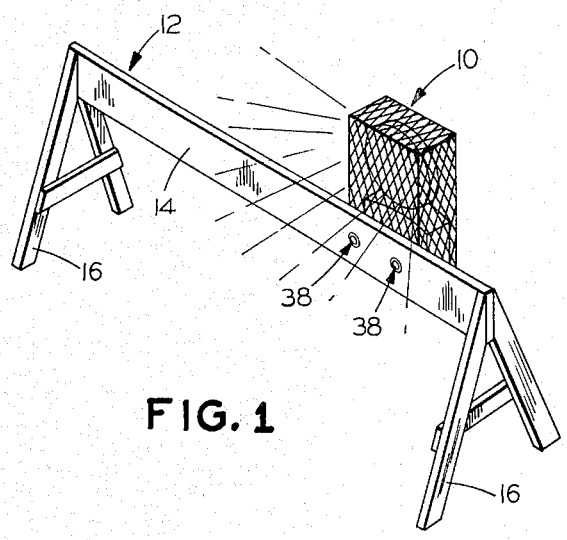
FIG. 1 is a perspective view of an assembly comprising an illuminating means and a protective container therefor constructed in accordance with the present invention, illustrated mounted on a barricade.

Referring now to the drawings and more particularly FIG. 1 thereof, there is illustrated therein an assembly, generally designated by reference numeral 10, constructed in accordance with the present invention. The assembly 10 as shown in FIG. 1 is mounted on a barricade 12 in a manner which will be more fully described subsequently. The barricade 12 is of a conventional construction which is well-known to those skilled in the art. More specifically, the barricade 12 is made of either wood or metal and consists of an elongated member 14 the opposite ends of which are supported on a pair of V-shaped leg members 16 so that the member 14 is positioned in spaced relation and substantially parallel to the ground or some other form of floor-like surface. As is well-known in the art, the member 14 may either be permanently affixed to the leg members 16 or detachably mounted thereto so as in the latter case to permit the barricade 12 to be collapsed for purposes of facilitating the transport of the barricade 12 from one location to another.

The assembly 10 comprises an illuminating means 18 and a protective container 20 therefor. The illuminating means 18 is of the type intended to be employed at a hazardous location for purposes of providing a visual warning that danger exists thereat. In accord with the illustrated embodiment of the invention, the illuminating means 18 comprises a flasher lamp of basically two-part construction, i.e., a lamp means 22 and a housing means 24. Inasmuch as the manner in which the flasher lamp 18 operates as well as the nature of the internal construction thereof are all readily well-known to those skilled in the art and since they are not directly related to the present invention, only a brief description of the structure embodied in the flasher lamp 18 will be found set forth hereinafter.

Referring now more particularly to the nature of the flasher lamp 18, the latter is of the type which is capable of operating to produce a flashing light. To this end, the flasher lamp 18 embodies therewithin its own self-contained power supply (not shown). In addition, the flasher lamp 18 is of the type which in appearance is characterized by the fact that the lamp means 22 which is generally circular in configuration is of a distinctive yellowish orange color. The lamp means 22 of the flasher lamp 18 consists of a bulb (not shown) and a cover therefor made from a suitable translucent material thereby to permit light rays to pass therethrough. The housing means 24 of the flasher lamp 18 houses therewithin the components of the aforereferenced self-contained power supply which by way of example may be in the form of a battery. Although not shown in the drawings, it is to be understood that the flasher lamp 18 is provided with suitable sealing means operable to provide the flasher lamp 18 with a watertight construction that is capable of affording adequate protection to the flasher lamp 18 to enable the latter to resist the effects of adverse weather conditions when utilized outdoors. Moreover, the housing means 24 preferably includes a housing made from a suitable impact-resistant plastic material capable of resisting the type of abuse encountered during normal usage thereof. One form of flasher lamp 18 possessing the above described characteristics is commercially available from the R. L. Dietz Company of Syracuse, New York. However, it should be noted that the particular form of flasher lamp 18 which is employed is not critical to the present invention.

Referring again to FIG. 2 of the drawings, the protective container 20 as depicted therein consists of an enclosure which is substantially rectangular in configuration and includes a plurality of interconnected wall portions consisting of side walls 20*a*, a top end wall 20*b* connected to the side walls 20*a*, and an open bottom end wall 26. The enclosure 20 is formed from a suitable wire mesh material. In this connection, one type of material which has been found to be suitable for this purpose is nine gauge, three quarter inch expanded flat metal plate. Although the side walls 20*a* and the top end wall 20*b* may be interconnected through the use of any suitable form of conventional connecting means, in accord with the illustrated embodiment of the invention, this is accomplished by welding the edges of the end walls 20*a* and the top end wall 20*b* together thereby to provide an enclosure 20 which is approximately 8 inches wide, fourteen inches high and four inches deep. As best understood with reference to FIG. 3 of the drawings, the protective container 20 is provided with mounting means 28 operable for purposes of supporting the flasher lamp 18 therewithin. In accord with the preferred embodiment of the invention, the mounting means 28 includes a special lock bolt 30 which has a length that is less than the depth of the protective container 20. The diameter of the special lock bolt 30 is suitably dimensioned so as to enable the lock bolt 30 to be inserted through the hollow center of a washer 32. The washer 32 is welded to the inside surface of one of the long side walls 20*a* so that the opening therein is coaxial with one of the openings inherently provided in the side walls 20*a* by virtue of the mesh construction thereof and so as to be suitably positioned adjacent to but spaced from the open bottom end wall 26 of the protective container 20. The special lock bolt 30 is preferably of metal construction so as to have sufficient strength to be capable of supporting thereon the weight of the flasher lamp 18.

In order to assemble the flasher lamp 18 within the protective container 20, the former is first inserted into the latter through the open bottom end wall 26 of the container 20 so that the lamp means 22 of the flasher lamp 18 is positioned adjacent the inside surface of the top end wall 20*b*. With the flasher lamp 18 so positioned, an opening (not shown) which is formed in the housing means 24 of the flasher lamp 18 is aligned with the hollow center of the washer 32. The special lock bolt 30, which as will be referred to more fully subsequently, requires the use of a special tool for its operation, is passed through the side wall 20*a* and the hollow center of the washer 32 and is received in the aforedescribed opening (not shown) in the flasher lamp 18. Preferably at least a portion of the special lock bolt 30 is threaded so as to enable the establishment of a threaded connection between the lock bolt 30 and the housing means 24 of the flasher lamp 18. To this end, the housing means 24 is provided with a suitable threaded portion capable of being cooperatively engaged by the threads on the special lock bolt 30. In this connection, a portion of the aforedescribed opening (not shown) in the housing means 24 may be suitably threaded or else an internally suitably dimensioned member may be supported along the length of the aforereferenced opening (not shown) in the housing means 24 so as to be positioned for engagement by the special lock bolt 30. The special lock bolt 30 is provided with an enlarged head 30*a* the diameter of which is greater than the diameter of the hollow center of the washer 32. Accordingly, the head 30*a* of the special lock bolt 30 functions as a stop means preventing the lock bolt 30 from being inserted completely through the side wall 20*a* and more particularly completely through the washer 32.

For purposes of causing the rotation of the special lock bolt 30, the latter is provided with a polygonal shaped opening 34 formed in the head 30*a* thereof. A pin 36 extends outwardly from the base of the opening 34, the length of which is such that the unattached end of the pin 36 is substantially flush with the top of the opening 34. The pin 36 may either be formed as a separate member which is fixedly attached at one end such as by welding to the bottom of the opening 34, or the in 36 may be formed as an integral part of the head 30*a*. Because of the presence of the aforedescribed pin 36, a special tool (not shown) must be utilized for purposes of causing the rotation of the special lock bolt 30. More specifically, a tool is required which has a portion which is of polygonal shape and suitably dimensioned so as to be insertable within the opening 34 and which in addition has a hole formed therein suitably located so as to be capable of receiving the pin 36. The purpose of requiring the use of such a special tool is to prevent the unauthorized removal of the flasher lamp 18 from within the interior of the protective container 20, i.e., to cause the flasher lamp 18 to be locked to the protective container 20.

With the flasher lamp 18 supported in the protective container 20 in the manner described in the preceding paragraph, the resulting assembly 10 is attached to the barricade 12 by means of fastener means 38. The latter fastener means 38 in accord with the illustrated embodiment of the invention comprises a pair of bolts 42 which are inserted through suitable openings 40, only one of which is visible in FIG. 2 of the drawings, provided therefor in the elongated member 14 of the barricade 12 suitably located intermediate the ends thereof. The bolts 42, which are each first preferably passed through a washer 44 having a diameter which is greater than the diameter of the openings 40, are of a sufficient length to extend through the aforedescribed openings 40 in the barricade 12 and into the interior of the protective container 20 passing through openings which exist in the side wall 20*a* as a result of the mesh construction thereof. At least the ends of the bolts 42 are provided with threads (not shown) whereby nuts 46 may be threaded thereon. Washers 48 suitably dimensioned so that the diameter thereof exceeds the diameter of the openings existing in the side walls 20*a* are positioned on the bolts 42 so as to be interposed between the inner surface of the side wall 20*a* and the nuts 46 whereby the washers 48 function as stop means limiting movement of the ends of the bolts 42 on which the nuts 46 are received, i.e., preventing the ends of the bolts 42 with the nuts 46 threaded thereon from passing through the side wall 20*a*.

Figure 2:
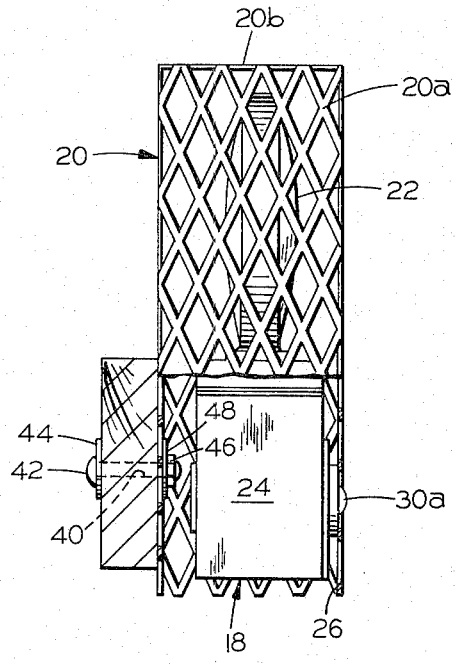
FIG. 2 is a side elevational view of an assembly comprising an illuminating means and a protective container therefor constructed in accordance with the present invention illustrated mounted on a barricade and with parts broken away for purposes of clarity of illustration.
Figure 3:
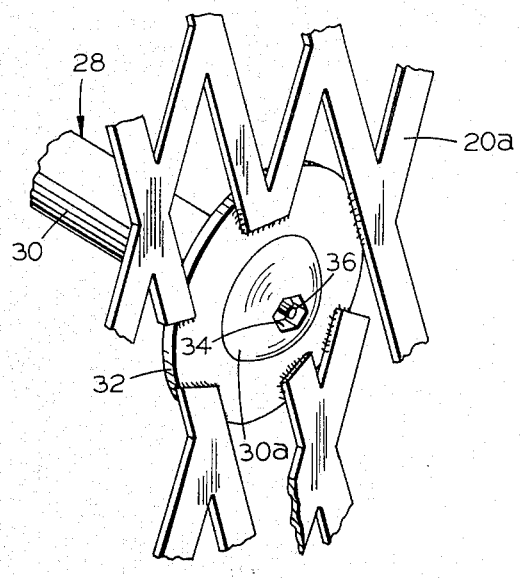
FIG. 3 is a perspective view of a portion of the front wall of an assembly comprising an illuminating means and a protective container therefor constructed in accordance with the present invention illustrating the mounting means which is utilized for purposes of mounting the illuminating means within the protective container.
Figure 4:
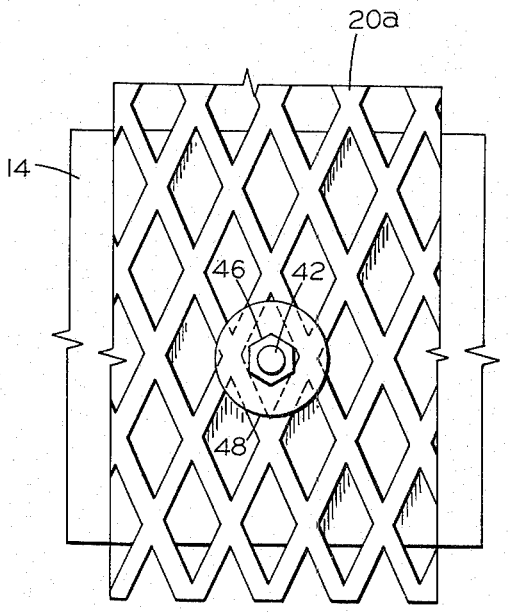
FIG. 4 is a side elevational view of a portion of the rear wall of an assembly comprising an illuminating means and a protective container therefor constructed in accordance with the present invention illustrating the means employed for mounting the assembly on a barricade.

Thus, with reference to FIGS. 1, 2 and 4 of the drawings, it can readily be understood that the manner in which the assembly 10 is attached to the barricade 12 is accomplished by inserting the bolts 42 with the washers 44 positioned thereon through the openings 40 into the interior of the protective container 20. Thereafter, the washers 48 are placed on the ends of the bolts 42 and the nuts 46 are threaded thereon. The nuts 46 are then tightened to provide a secure connection between the barricade 12 and the assembly 10. To prevent the unauthorized removal of the assembly 10 from the barricade 12, the nuts 46 are preferably tack welded in place.

Although only one embodiment of an assembly of a flasher lamp and protective container therefor constructed in accordance with the present invention has been shown in the drawings and described hereinabove, it is to be understood that modifications in the construction thereof may be made thereto by those skilled in the art without departing from the essence of invention. In this connection, some of the modifications which can be made in the assembly 10 have been alluded to hereinabove while others will become readily apparent to those skilled in the art when exposed to the present description and illustration of the construction of the assembly 10. For example, although the assembly of the present invention has been described in connection with the embodiment therein of one particular type of flasher lamp, it is to be understood that other forms of illuminating means capable of emitting either an intermittent or continuous beams of light may be employed without departing from the essence of the invention. In addition, it is to be understood that the configuration of the protective container 20 may take some shape other than the rectangular shape illustrated in the drawings without departing from the essence of the invention. Moreover, some other form of mounting means may be utilized for purposes of supporting the flasher lamp in the protective container other than the special lock bolt 30. However, mounting means employed in this connection should provide the capability of preventing the unauthorized removal of the flasher lamp from the protective container. Furthermore, another form of fastener means may be employed without departing from the essence of the invention to attach the assembly 10 to an external support member such as a barricade.

Therefore, it can be seen that the present invention provides a novel and improved assembly consisting of an illuminating means operable as a warning device and of a protective container therefor. Moreover, in accord with the present invention such an assembly of an illuminating means and a protective container therefor has been provided which also embodies mounting means operable for mounting the assembly to an external support member. The assembly of an illuminating means and a protective container therefor of the present invention provides a protective container which is operable for purposes of protecting the illuminating means from damage done as a result of vandalism, or from being struck and knocked down, or when the illuminating means is being placed into or removed from a vehicle, etc. Furthermore in accordance with the present invention, such an assembly of an illuminating means and a protective container therefor has been provided wherein the protective container is operable to protect the illuminating means against theft. Also, an embodiment of an illminating means and a protective container therefor has been provided wherein access is still capable of being had to the illuminating means to enable maintenance to be performed thereon and/or minor repairs to be made thereto. Finally, in accord with the present invention an assembly of an illuminating means and a protective container therefor has been provided which is easy to employ and is not readily susceptible to the effects of exposure to different weather conditions, yet is simple to assemble and relatively inexpensive to manufacture.

Having thus described the invention, I claim:

1. A portable flasher assembly for mounting on barricades or the like comprising:

a. a flasher unit including a housing containing a power source and a lamp unit;

b. an impact resistant protective container extending about said flasher unit and having a multiplicity of interconnected sidewall portions and an endwall portion, said container providing a chamber receiving said flasher unit and open at one end to permit insertion and withdrawal of said flasher unit without disassembly of said unit, at least some of said wall portions being light transmitting to permit said lamp unit to send light rays outwardly therefrom:

c. lockable mounting means mounting said housing of said flasher unit to one sidewall portion within said container and accessible through a sidewall portion of said container so as to permit unlocking thereof and removal of said flasher unit for servicing; and d. lockable fastening means extending outwardly from another one of said sidewall portions of said container member for fastening said flasher assembly to a barricade or like support member, said fastening means being adapted to provide locked assembly of said flasher assembly upon the associated support member.

2. The portable flasher assembly of claim 1 wherein said housing contains a battery providing electrical energy to said lamp unit, wherein said open end is at the bottom of said protective container and wherein the lower end of said housing is disposed upwardly from the lower end of said protective container.

3. The portable flasher assembly of claim 1 wherein said sidewall portions and endwall portions are fabricated from a metal mesh with light rays being transmittable through the openings of said mesh.

4. The portable flasher assembly of claim 1 wherein said lockable mounting means comprises a washer fixed on one of said sidewall portions, a lock bolt extending through said one sidewall portion and washer, said lock bolt being engaged with said housing of said flasher unit to lock said flasher unit within said protective container, said lock bolt being configured to require a special tool to effect disengagement thereof so as to minimize the likelihood of improper removal of said flasher unit from said protective container.

5. The portable flasher assembly of claim 1 wherein said lockable fastening means comprises threaded fasteners having a head portion and a shank portion extending through said another one of said sidewall portions and of a length sufficient to permit passage through a barricade or like support member and a nut threadably engageable on said shank, said nut being adapted to be tack welded in tightened assembly to prevent the unauthorized dismounting.

6. A portable flasher assembly for mounting on barricades or the like comprising:

a. a flasher unit including a housing containing a battery and a lamp unit;

b. an impact resistant protective container extending about said flasher unit and having a multiplicity of interconnected metal mesh sidewall portions and a top wall portion, said container providing a chamber receiving said flasher unit and open at the bottom end to permit insertion and withdrawal of said flasher unit without disassembly of said unit, said container having its lower end spaced below the lower end of said flasher unit housing, said mesh wall portions being light transmitting to permit said lamp unit to send light rays outwardly therefrom;

c. lockable mounting means mounting said housing of said flasher unit to one sidewall portion within said container and accessible through a sidewall portion of said container so as to permit unlocking thereof and removal of said flasher unit for servicing; and d. lockable fastening means extending outwardly from the sidewall portion of said container member opposite said one sidewall portion thereof for fastening said flasher assembly to a barricade or like support member, said fastening means being adapted to provide locked assembly of said flasher assembly upon the associated support member.

7. The portable flasher assembly of claim 6 wherein said lockable mounting means comprises a washer fixed on one of said sidewall portions, a lock bolt extending through said one sidewall portion and washer, said lock bolt being engaged with said housing of said flasher unit to lock said flasher unit within said protective container, said lock bolt being configured to require a special tool to effect disengagement thereof so as to minimize the likelihood of improper removal of said flasher unit from said protective container.

8. The portable flasher assembly of claim 6 wherein said lockable fastening means comprises threaded fasteners having a head portion and a shank portion extending through said opposite sidewall portion and of a length sufficient to permit passage through a barricade or like support member and a nut threadably engageable in said shank, said nut being adapted to be tack welded in tightened assembly to prevent the unauthorized dismounting.

* * * * *